US011826284B2

(12) United States Patent
Xu et al.

(10) Patent No.: US 11,826,284 B2
(45) **Date of Patent: *Nov. 28, 2023**

(54) PATIENT SUPPORT APPARATUS WITH A SIDE RAMP

(71) Applicant: Stryker Corporation, Kalamazoo, MI (US)

(72) Inventors: Shaofei Wilson Xu, Kalamazoo, MI (US); Lance Erick Larsen, Grand Rapids, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/844,319

(22) Filed: Jun. 20, 2022

(65) Prior Publication Data

US 2022/0313506 A1 Oct. 6, 2022

Related U.S. Application Data

(63) Continuation of application No. 16/690,218, filed on Nov. 21, 2019, now Pat. No. 11,389,347.

(Continued)

(51) Int. Cl.

*A61G 1/003* (2006.01)
*A61G 1/013* (2006.01)

(Continued)

(52) U.S. Cl.

CPC ..... *A61G 1/003* (2013.01); *A61G 1/013* (2013.01); *A61G 1/02* (2013.01); *A61G 5/066* (2013.01); *A61G 7/0507* (2013.01)

(58) Field of Classification Search

CPC ..... A61G 1/003; A61G 1/013; A61G 1/02; A61G 1/00; A61G 1/0212; A61G 1/0237; A61G 1/04; A61G 5/066

See application file for complete search history.

(56) References Cited

U.S. PATENT DOCUMENTS 2,984,842 A * 5/1961 Richards ..... A61G 1/003 5/81.1 C
4,002,330 A * 1/1977 Johansson ..... A61G 7/0005 5/606

(Continued)

FOREIGN PATENT DOCUMENTS

CN 108175604 A 6/2018
CN 108175604 A * 6/2018

(Continued)

*Primary Examiner* — Michael Safavi

(74) *Attorney, Agent, or Firm* — Howard & Howard Attorneys PLLC

(57) ABSTRACT

A patient support apparatus supports a patient and comprises a litter. The litter comprises a patient support deck and extends longitudinally between first and second ends. A base is configured to support the litter and comprises a base lift mechanism configured to move the litter between lifted and lowered base positions. A side ramp is coupled to the patient support deck along the litter between the first and second ends and extends laterally away from the patient support deck to an engagement end. The side ramp is pivotable relative to the litter between first and second positions. In the first position, the side ramp is planar with or angled upwardly to extend above the patient support deck. In the second position, the side ramp is angled downwardly to extend below the patient support deck for contacting the floor surface with the engagement end when in the lowered base position.

15 Claims, 10 Drawing Sheets

Related U.S. Application Data

(60) Provisional application No. 62/770,277, filed on Nov. 21, 2018.

(51) Int. Cl.

| | |
|---|---|
| ***A61G 1/02*** | (2006.01) |
| ***A61G 5/06*** | (2006.01) |
| *A61G 7/05* | (2006.01) |

(56) References Cited

U.S. PATENT DOCUMENTS

| | | | | | |
|---|---|---|---|---|---|
| 4,044,850 | A | * | 8/1977 | Winsor | A61G 5/045 180/9.26 |
| 4,767,148 | A | * | 8/1988 | Ferneau | A61G 1/0567 296/20 |
| 5,575,026 | A | * | 11/1996 | Way | A61G 1/0567 5/611 |
| 7,398,571 | B2 | | 7/2008 | Souke et al. | |
| 9,486,373 | B2 | | 11/2016 | Lambarth et al. | |
| 9,510,981 | B2 | | 12/2016 | Lambarth et al. | |
| 2006/0123545 | A1 | * | 6/2006 | Johnson | A61G 1/0237 5/611 |
| 2009/0178200 | A1 | * | 7/2009 | Lambarth | A61G 1/0567 5/611 |
| 2012/0274051 | A1 | | 11/2012 | Purdue | |
| 2013/0269103 | A1 | | 10/2013 | Van Oirschot | |
| 2016/0081863 | A1 | * | 3/2016 | Belsinger, Jr | A61G 1/048 128/872 |
| 2017/0079859 | A1 | * | 3/2017 | Lambarth | A61G 1/0275 |
| 2018/0028383 | A1 | * | 2/2018 | Stryker | A61G 1/013 |
| 2018/0177652 | A1 | | 6/2018 | Furman et al. | |
| 2018/0177654 | A1 | * | 6/2018 | Muscarello | A61G 1/04 |
| 2018/0185212 | A1 | | 7/2018 | Lucas et al. | |
| 2018/0185213 | A1 | | 7/2018 | Naber et al. | |
| 2019/0388285 | A1 | * | 12/2019 | Lambarth | A61G 5/1067 |
| 2020/0155380 | A1 | | 5/2020 | Xu et al. | |

FOREIGN PATENT DOCUMENTS

| | | | | | |
|---|---|---|---|---|---|
| CN | 109009694 | A | | 12/2018 | |
| CN | 109009694 | A | * | 12/2018 | |
| CN | 109009698 | A | | 12/2018 | |
| CN | 109009698 | A | * | 12/2018 | |
| CN | 109350373 | A | * | 2/2019 | |
| CN | 109350373 | A | | 2/2019 | |
| CN | 109381298 | A | * | 2/2019 | |
| CN | 109381298 | A | | 2/2019 | |
| CN | 112006852 | A | | 12/2020 | |
| CN | 112006852 | A | * | 12/2020 | |
| CN | 112006854 | A | | 12/2020 | |
| CN | 112006854 | A | * | 12/2020 | |
| CN | 112336528 | A | * | 2/2021 | |
| CN | 112336528 | A | | 2/2021 | |
| CN | 113057805 | A | * | 7/2021 | |
| CN | 113057805 | A | | 7/2021 | |
| CN | 113112752 | A | | 7/2021 | |
| CN | 113112752 | A | * | 7/2021 | |
| CN | 113143613 | A | | 7/2021 | |
| CN | 113143613 | A | * | 7/2021 | |
| DE | 1960371 | A1 | | 6/1971 | |
| DE | 1960371 | A1 | * | 6/1971 | |
| DE | 3524225 | A1 | | 1/1987 | |
| DE | 3524225 | A1 | * | 1/1987 | A61G 1/0212 |
| DE | 3524279 | A1 | | 1/1987 | |
| DE | 3524279 | A1 | * | 1/1987 | A61G 7/0514 |
| FR | 2334340 | A1 | | 7/1977 | |
| FR | 2334340 | A1 | * | 7/1977 | |
| FR | 2855402 | A1 | | 12/2004 | |
| FR | 2855402 | A1 | * | 12/2004 | A61G 5/061 |
| GB | 2068850 | A | * | 8/1981 | A61G 7/1046 |
| GB | 2068850 | A | | 8/1981 | |
| KR | 20090000756 | U | * | 1/2009 | |
| KR | 101841396 | B1 | * | 3/2018 | |
| KR | 101841396 | B1 | | 3/2018 | |

* cited by examiner

PATIENT SUPPORT APPARATUS WITH A SIDE RAMP

CROSS-REFERENCE TO RELATED APPLICATIONS

The subject patent application is a Continuation of U.S. patent application Ser. No. 16/690,218, filed on Nov. 21, 2019, which claims priority to and all the benefits of U.S. Provisional Patent Application No. 62/770,277, filed on Nov. 21, 2018, the disclosures of each of which are hereby incorporated by reference in their entirety.

BACKGROUND

Patient support apparatuses facilitate care of patients in a health care setting and are typically, for example, hospital beds, stretchers, cots, tables, wheelchairs, and chairs. A conventional patient support apparatus comprises a base and a litter upon which the patient is supported.

Often, patient support apparatuses are capable of being lowered toward the ground for reducing the vertical distance that a patient must be moved from floor surface to the litter. The patient may be moved to the litter in several ways. The patient may be slid over and secured to a rigid backboard that is then lifted by emergency responders to the litter. Alternatively, a bed sheet may be placed under the patient and then lifted by emergency responders onto the litter. While effective, the emergency responders must lift the patient off the floor surface and place the patient on the litter, which is strenuous and increases the potential for injuring the emergency responder.

A patient support apparatus designed to move the patient from the floor surface to litter without lifting and overcome one or more of the aforementioned challenges is desired.

DETAILED DESCRIPTION OF THE EMBODIMENTS

Figure 1:
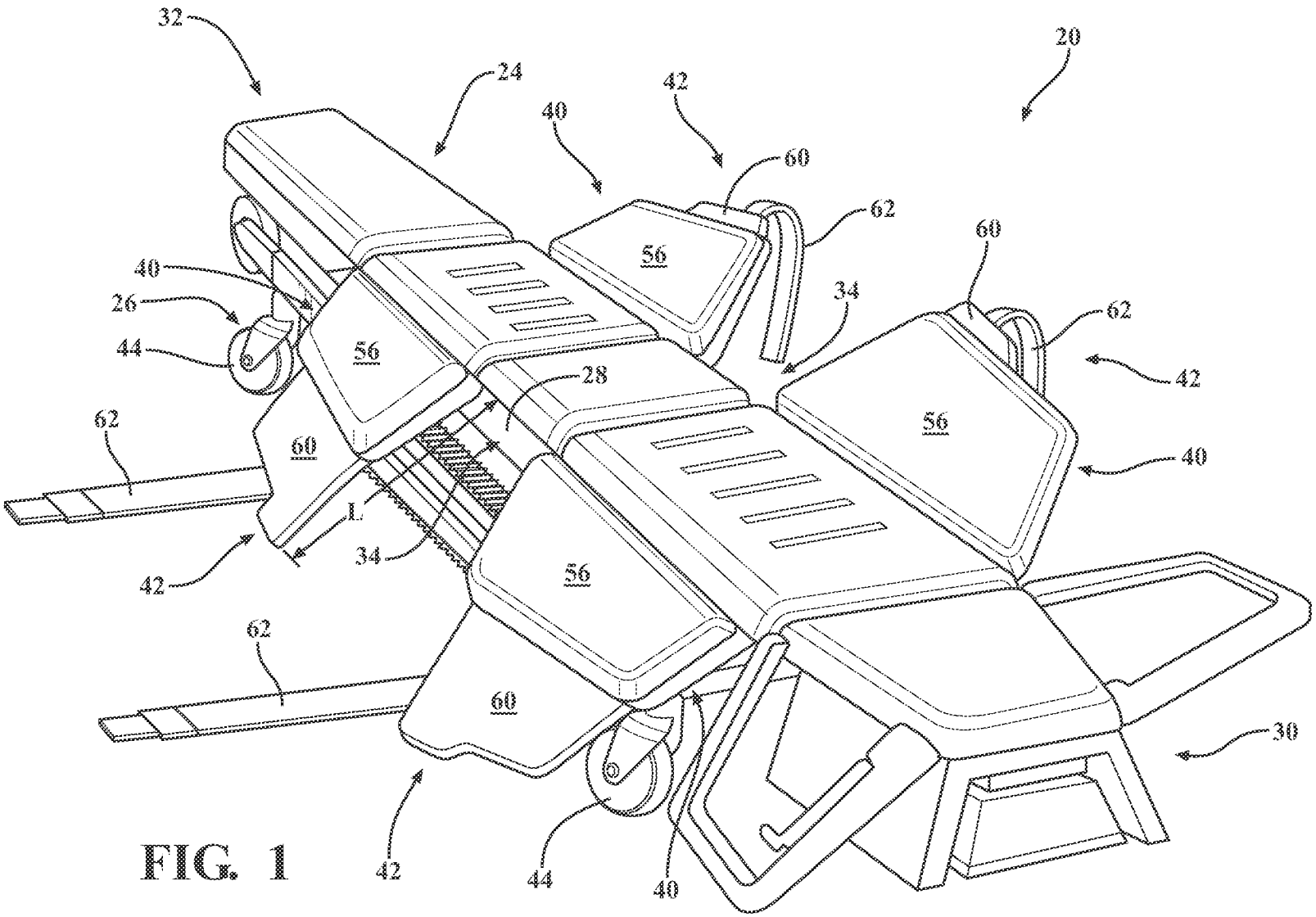
FIG. 1 is a perspective view of a patient support apparatus shown comprising a base and a litter.

Referring to FIG. 1, a patient support apparatus is shown at 20 for supporting a patient 22 in a health care setting. As will be appreciated from the subsequent description below, while the illustrated embodiments of the patient support apparatus 20 described herein are configured as cots for transporting patients 22, the patient support apparatus 20 may comprise a hospital bed, a stretcher, a table, a wheelchair, a chair, or a similar apparatus utilized in the care of the patient 22. The embodiment of the patient support apparatus 20 shown in FIG. 1 generally comprises a litter 24 and a base 26, each of which are described in greater detail below.

In some embodiments, the patient support apparatus 20 may comprise a reconfigurable patient support as described in U.S. Pat. No. 9,486,373, which is hereby incorporated by reference in its entirety. In some embodiments, the patient support apparatus 20 may comprise a reconfigurable transport apparatus as described in U.S. Pat. No. 9,510,981, which is hereby incorporated by reference in its entirety. In some embodiments, the patient support apparatus 20 may comprise a person support apparatus system as described in U.S. Patent Application Publication No. 2018/0028383, which is hereby incorporated by reference in its entirety. In some embodiments, the patient support apparatus 20 may comprise a patient transfer apparatus with integrated tracks as described in U.S. patent application Ser. No. 15/854,943, which is hereby incorporated by reference in its entirety. In some embodiments, the patient support apparatus 20 may comprise a variable speed patient transfer apparatus as described in U.S. patent application Ser. No. 15/854,199, which is hereby incorporated by reference in its entirety. In some embodiments, the patient support apparatus 20 may comprise a patient transfer apparatus as described in U.S. patent application Ser. No. 15/855,161, which is hereby incorporated by reference in its entirety. In some embodiments, the patient support apparatus 20 may comprise an ambulance cot as described in U.S. Pat. No. 7,398,571, which is hereby incorporated by reference in its entirety. In some embodiments, the patient support apparatus 20 may comprise an adaptive user interface as described in U.S. Pat. No. 7,398,571, which is hereby incorporated by reference in its entirety.

In the illustrated embodiment, the patient support apparatus 20 comprises the litter 24. The litter 24 comprises a patient support deck 28 configured to support the patient 22. The patient support deck 28 of the litter 24 may comprise several sections, some of which are capable of being articulated relative to others, such as a fowler section, a seat section, and a foot section. The fowler section and the foot section may pivot relative to the seat section, or may articulate relative to the seat section in any manner. For instance, the fowler section and/or the foot section may both pivot and translate relative to the seat section in some configurations. The articulation of the sections may configure the litter 24 to serve as a mobile chair to transport patients 22 up and down stairs. Mobile chairs (sometimes called "stair chairs") are used to evacuate patients 22 from buildings where patient accessibility is limited, such as buildings having more than one floor.

Figure 2:
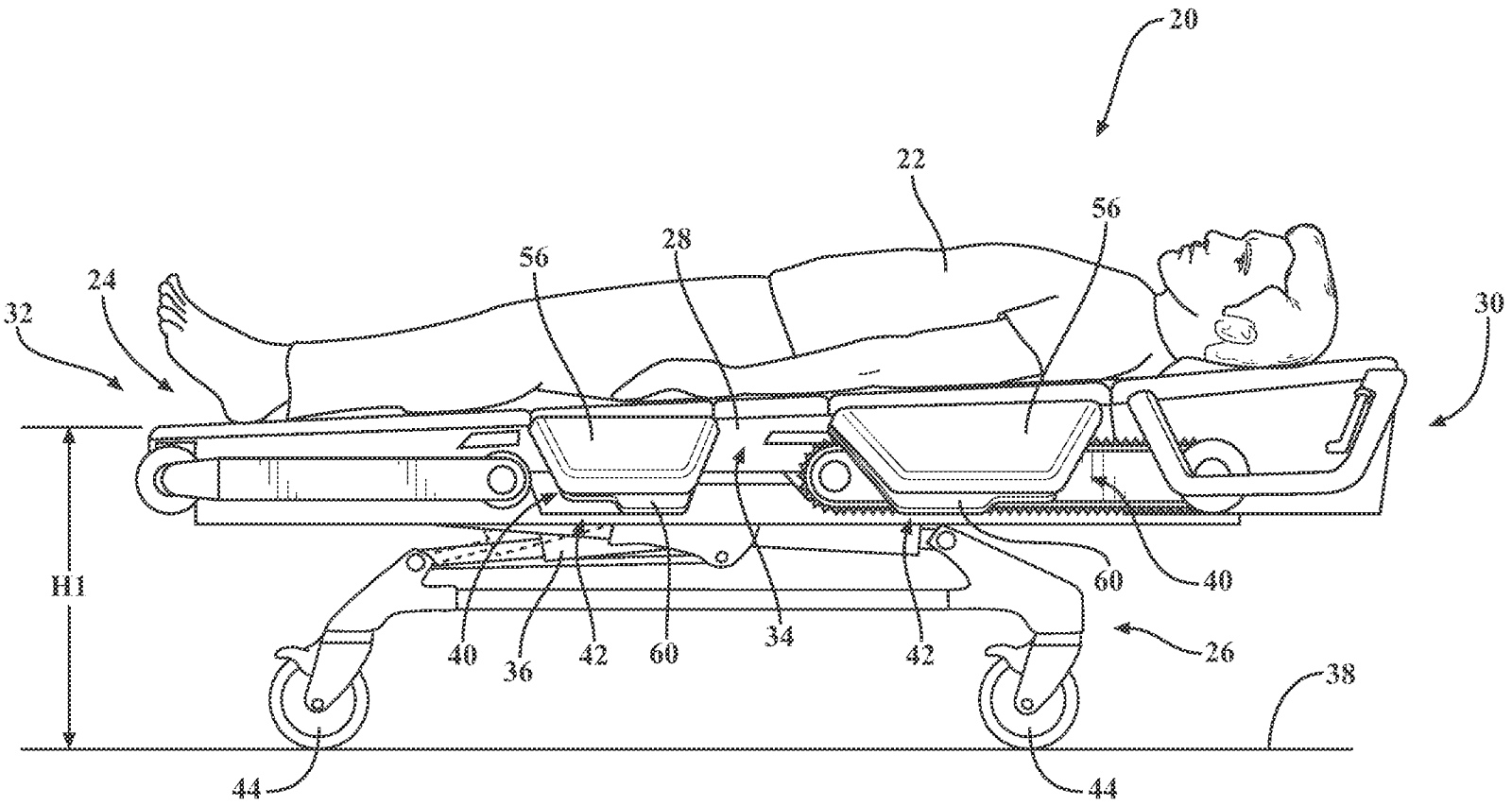
FIG. 2 is a side view of the patient support apparatus of FIG. 1, with the base supporting the litter in a lowered base position.
Figure 3:
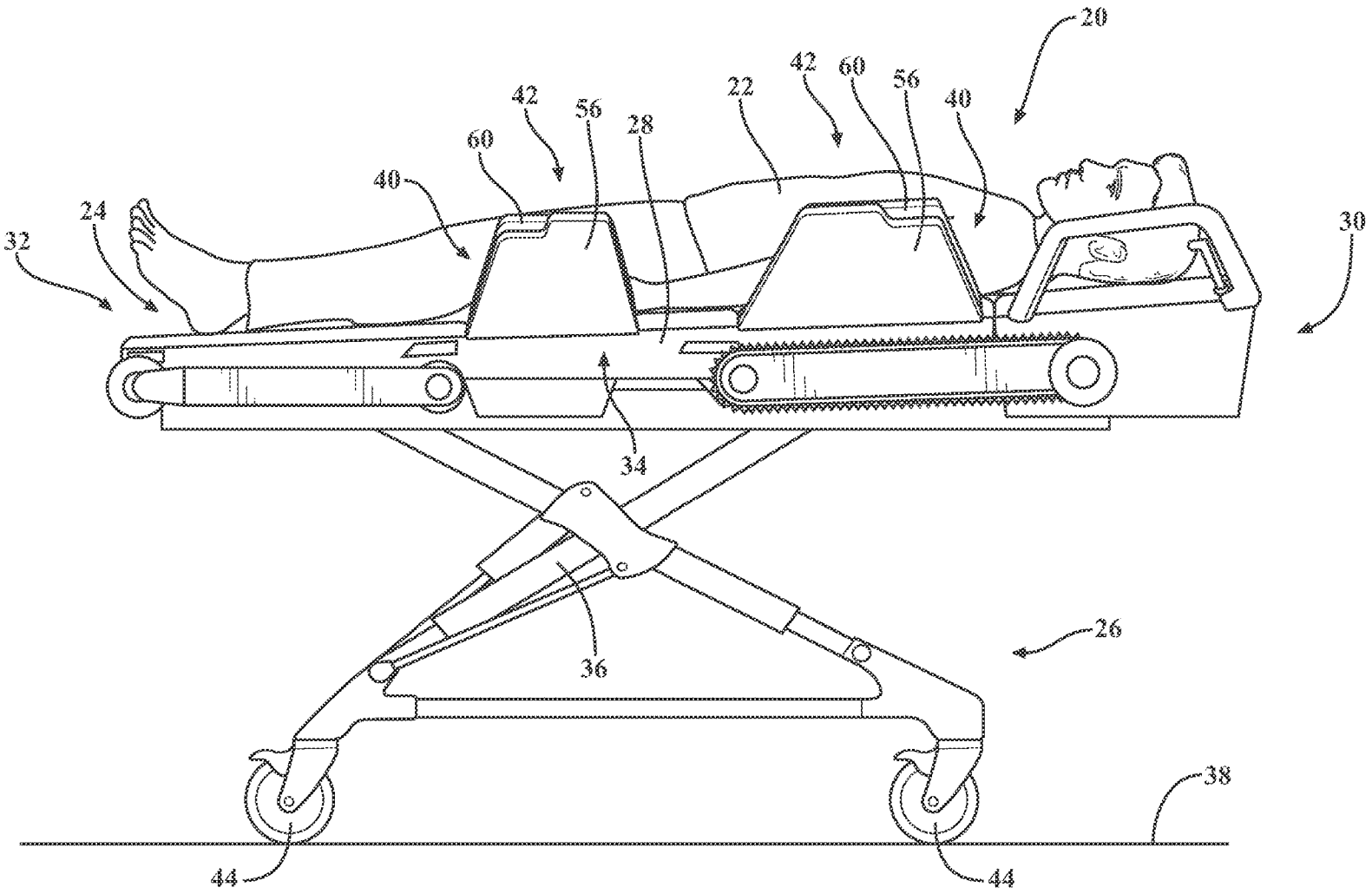
FIG. 3 is a side view of the patient support apparatus of FIG. 1, with the base supporting the litter in a lifted base position.
Figure 4A:
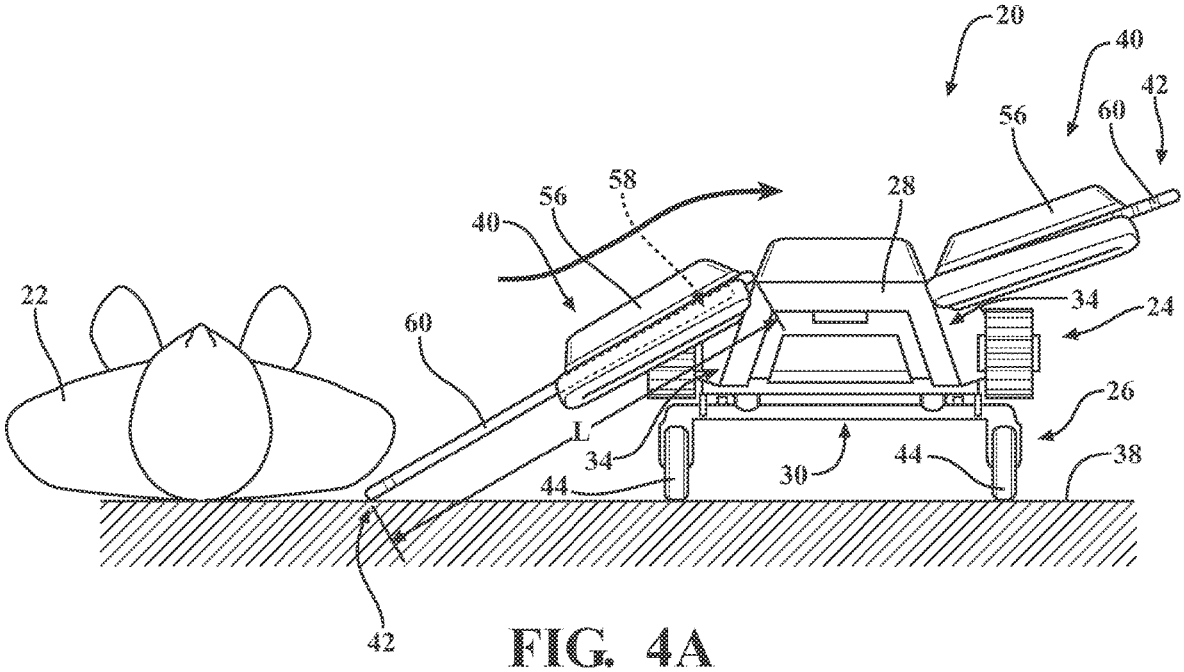
FIG. 4A is a side view of the patient support apparatus of FIG. 1 shown with a patient disposed on a floor surface adjacent the patient support apparatus.
Figure 4B:
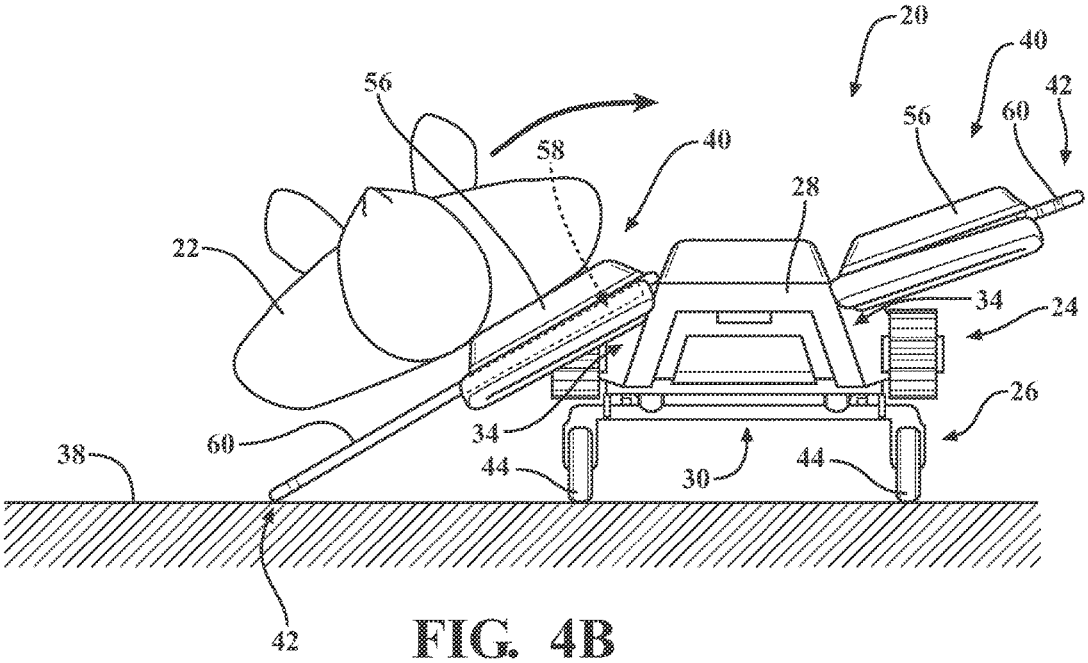
FIG. 4B is a side view of the 1 patient support apparatus of FIG. 1 shown with the patient disposed on a side ramp of the patient support apparatus.
Figure 4C:
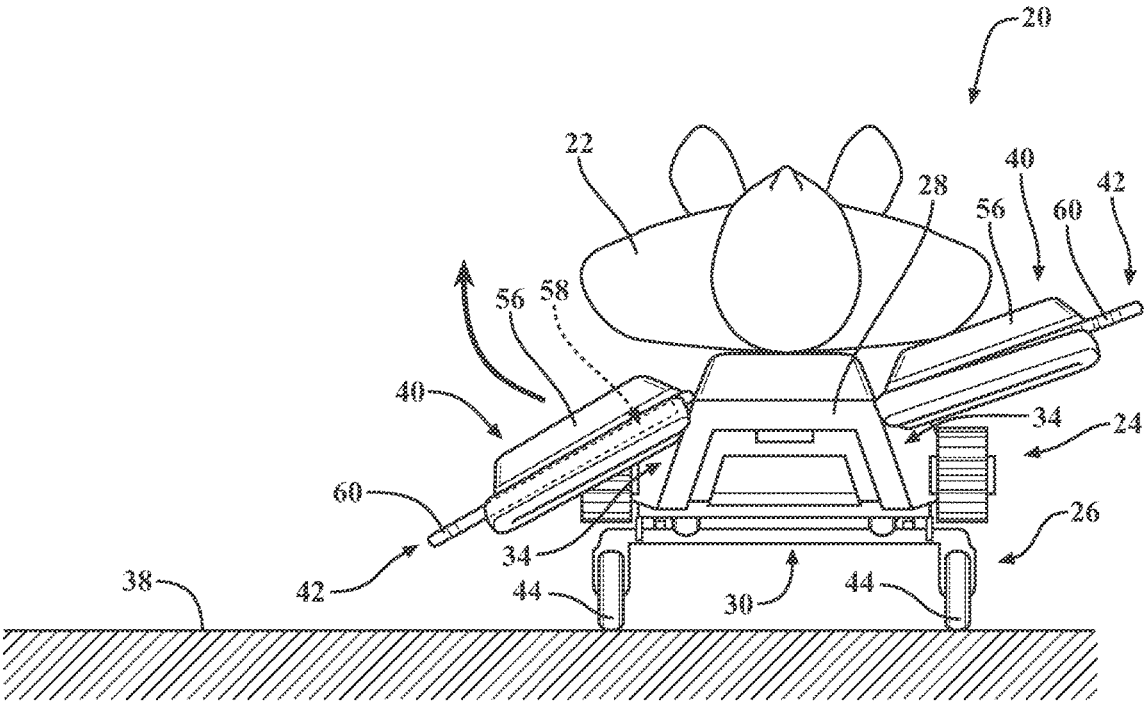
FIG. 4C is a side view of the patient support apparatus of FIG. 1 shown with the patient disposed on a patient support deck of the patient support apparatus.
Figure 4D:
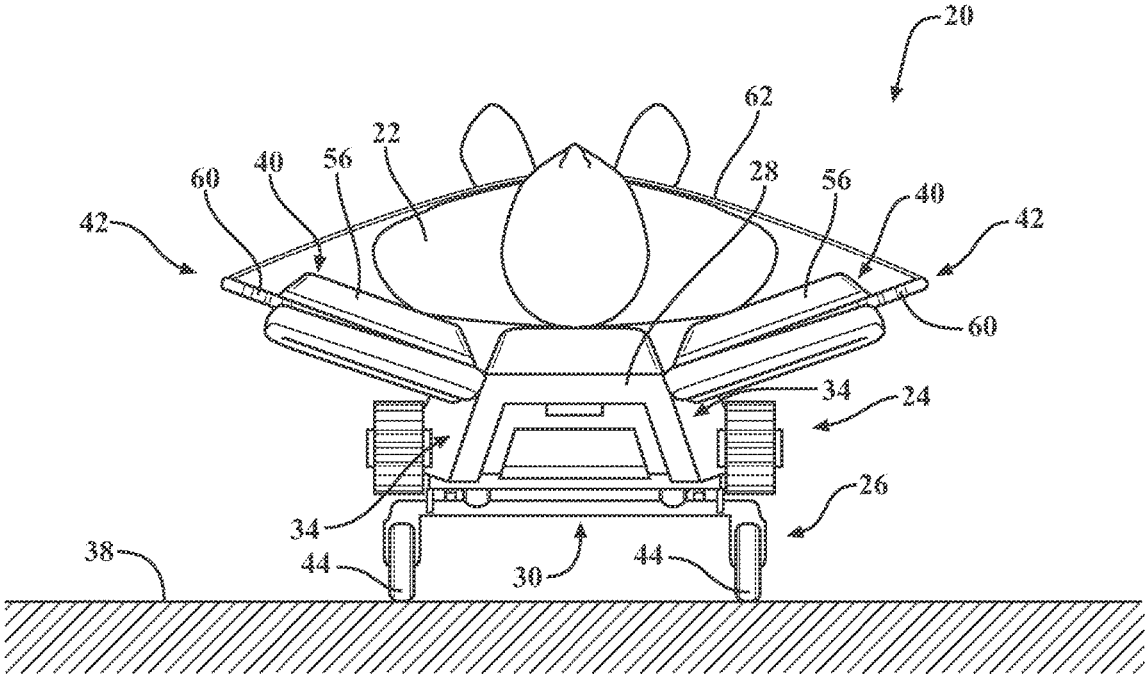
FIG. 4D is a side view of the patient support apparatus of FIG. 1 shown with the patient disposed on the patient support deck of the patient support apparatus, with both of the pair of side ramps in a first position.

As shown in FIGS. 1-3, the litter 24 extends longitudinally between a first end 30 and a second end 32. Furthermore, the patient support deck 28 may comprise a pair of opposing lateral sides 34 between the first and second ends 30, 32. The patient support apparatus 20 further comprises the base 26 configured to support the litter 24. As shown in FIGS. 1-3, the base 26 comprises a base lift mechanism 36 configured to move the litter 24 relative to a floor surface 38 between a lifted base position (see FIG. 3) and a lowered base position (see FIG. 2), and to a plurality of intermediate positions therebetween. The patient support apparatus 20 further comprises one or more side ramp 40 coupled to the patient support deck 28 along the litter 24 between the first and second ends 30, 32. The side ramp 40 extends laterally away from the patient support deck 28 to an engagement end 42. The side ramp 40 is pivotable relative to the litter 24 between a first position (see FIG. 4D) and a second position (see FIG. 4A-4C). In some embodiments, the side ramp 40 may be pivoted to additional positions between the first and second positions. In the first position, the side ramp 40 is planar with or angled upwardly to extend above the patient support deck 28 for inhibiting patient 22 egress. In the second position, the side ramp 40 is angled downwardly to extend below the patient support deck 28 for contacting the floor surface 38 with the engagement end 42 when in the lowered base position.

In certain scenarios, the patient 22 is immobilized and requires an emergency responder to load the patient 22 on the patient support deck 28. Traditionally, emergency responders lift the patient 22 off the floor surface 38 and place the patient 22 on the litter 24, which is strenuous and increases the potential for injuring the emergency responder. The side ramp 40 disposed in the second position facilitates movement of the patient 22 along the side ramp 40 during loading of the patient 22 from the floor surface 38 to the patient support deck 28, which provides the advantage of reducing strain and effort exerted by the emergency responder to place the patient 22 on the patient support deck 28.

The base lift mechanism 36 is coupled to the base 26 and is configured to raise and lower the litter 24 between the lifted and lowered base positions of the base 26, and intermediate positions therebetween, when the litter 24 is supported by the base 26. The base lift mechanism 36 may be configured to operate in the same manner or a similar manner as the base lift mechanisms shown in U.S. Pat. Nos. 7,398,571, 9,486,373, 9,510,981, and/or U.S. Patent Application Publication No. 2018/0028383, previously referenced. The base lift mechanism 36 may be powered (hydraulic, electric, etc.) or may be manually operated.

The base 26 is configured for movement of the litter 24 along the floor surface 38 (e.g., the ground). More specifically, the base 26 may comprise wheels 44 to facilitate transport over the floor surface 38, as shown in FIGS. 1-4D. The wheels 44 are arranged in each of four quadrants of the base 26. In the illustrated embodiments, the wheels 44 are caster wheels, which are able to rotate and swivel during transport. In addition, in some configurations, the wheels 44 are not caster wheels and may be non-steerable, steerable, non-powered, powered, or combinations thereof. Additional wheels are also contemplated. For example, the patient support apparatus 20 may comprise four non-powered, non-steerable wheels, along with one or more powered wheels. In some cases, the patient support apparatus 20 may not include any wheels. In other configurations, one or more auxiliary wheels (powered or non-powered), which are movable between stowed positions and deployed positions, may be coupled to the base 26. In some cases, when these auxiliary wheels contact the floor surface 38 in the deployed position, they cause two of the wheels 44 to be lifted off the floor surface 38 thereby shortening a wheelbase of the patient support apparatus 20. A fifth wheel may also be arranged substantially in a center of the base 26. Other configurations are contemplated.

The litter 24 may be selectively separable from the base 26. Said differently, the base 26 may be configured to removably receive and support the litter 24 in certain situations. In the illustrated embodiment, the litter 24 is configured for releasable attachment to the base 26. As will be appreciated from the subsequent description below, the litter 24 may be considered to be a patient support apparatus 20 both when it is attached to the base 26 (see FIGS. 1-4D) and when it has been removed from the base 26 (see FIGS. 5-8D).

Figure 5:
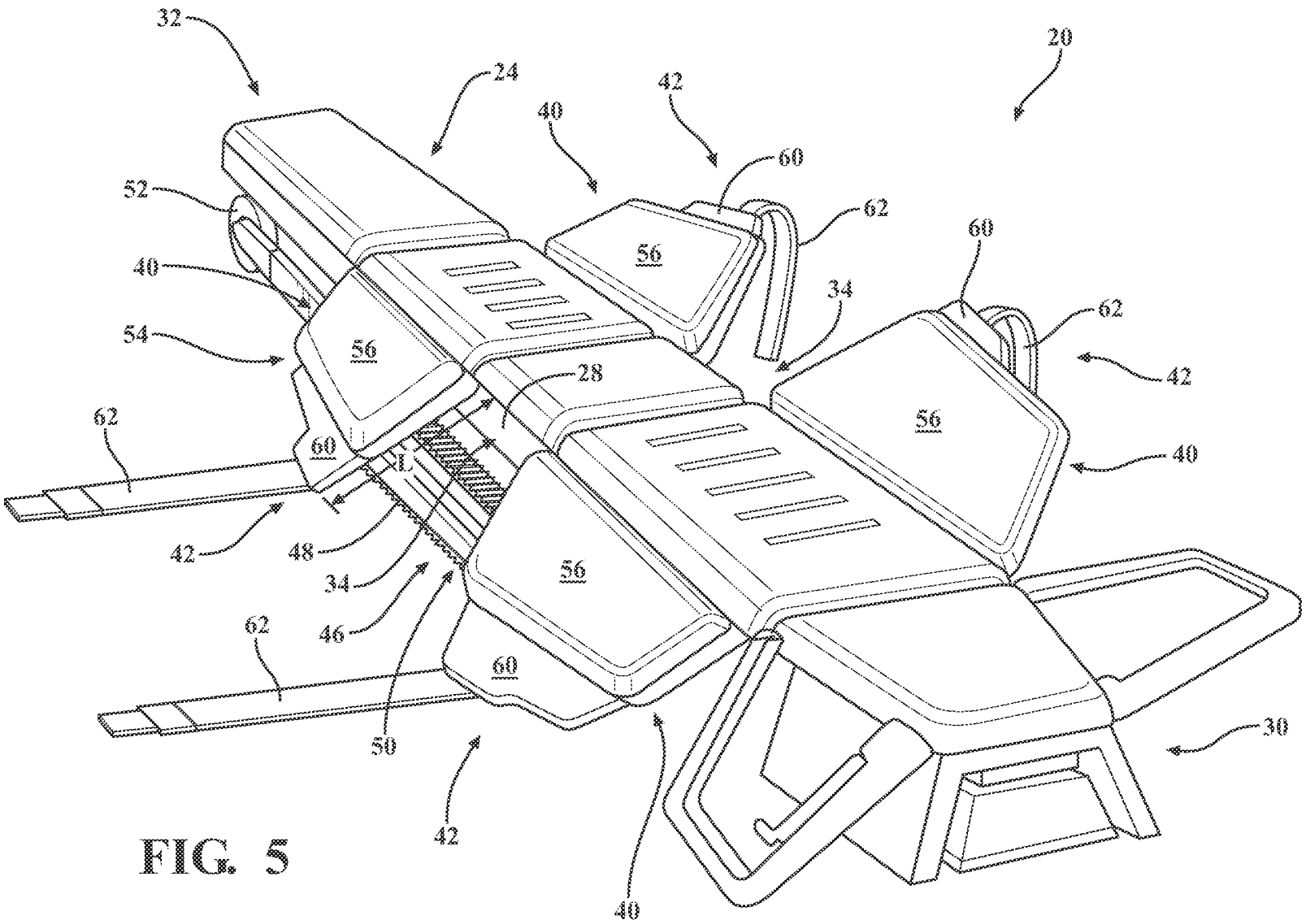
FIG. 5 is a perspective view of a patient support apparatus shown comprising the litter and a litter lift mechanism.
Figure 6:
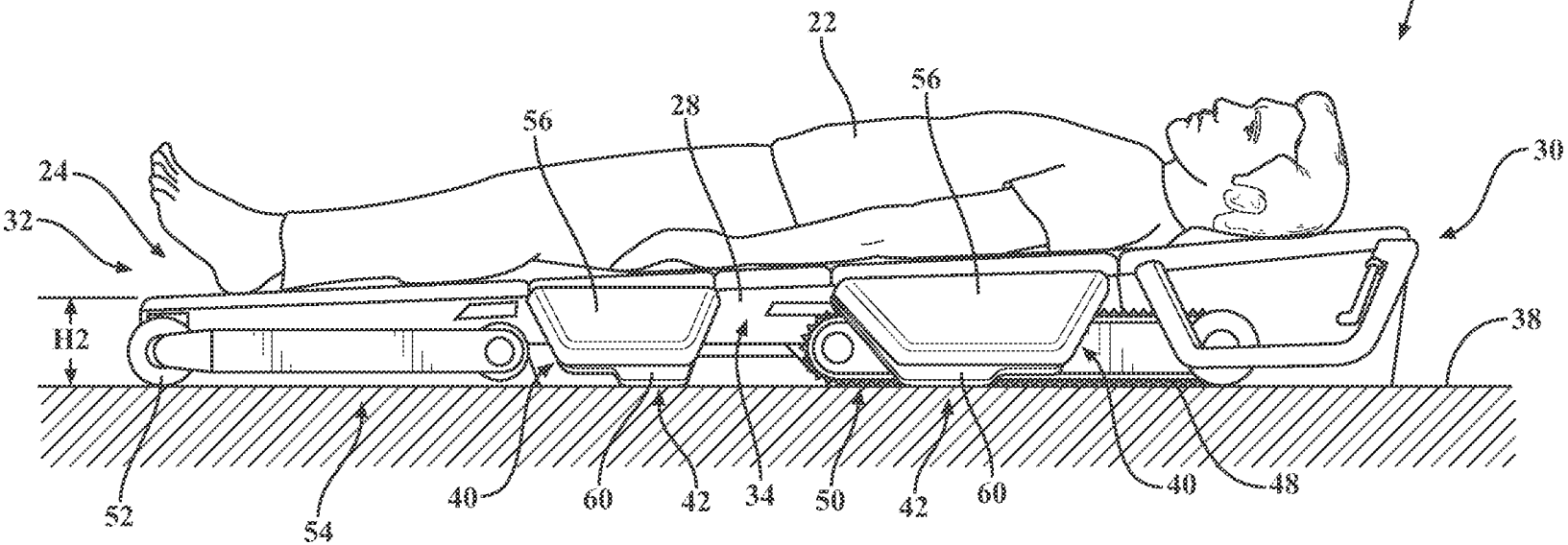
FIG. 6 is a side view of the patient support apparatus of FIG. 5, with the litter lift mechanism supporting the litter in a lowered litter position.
Figure 7:
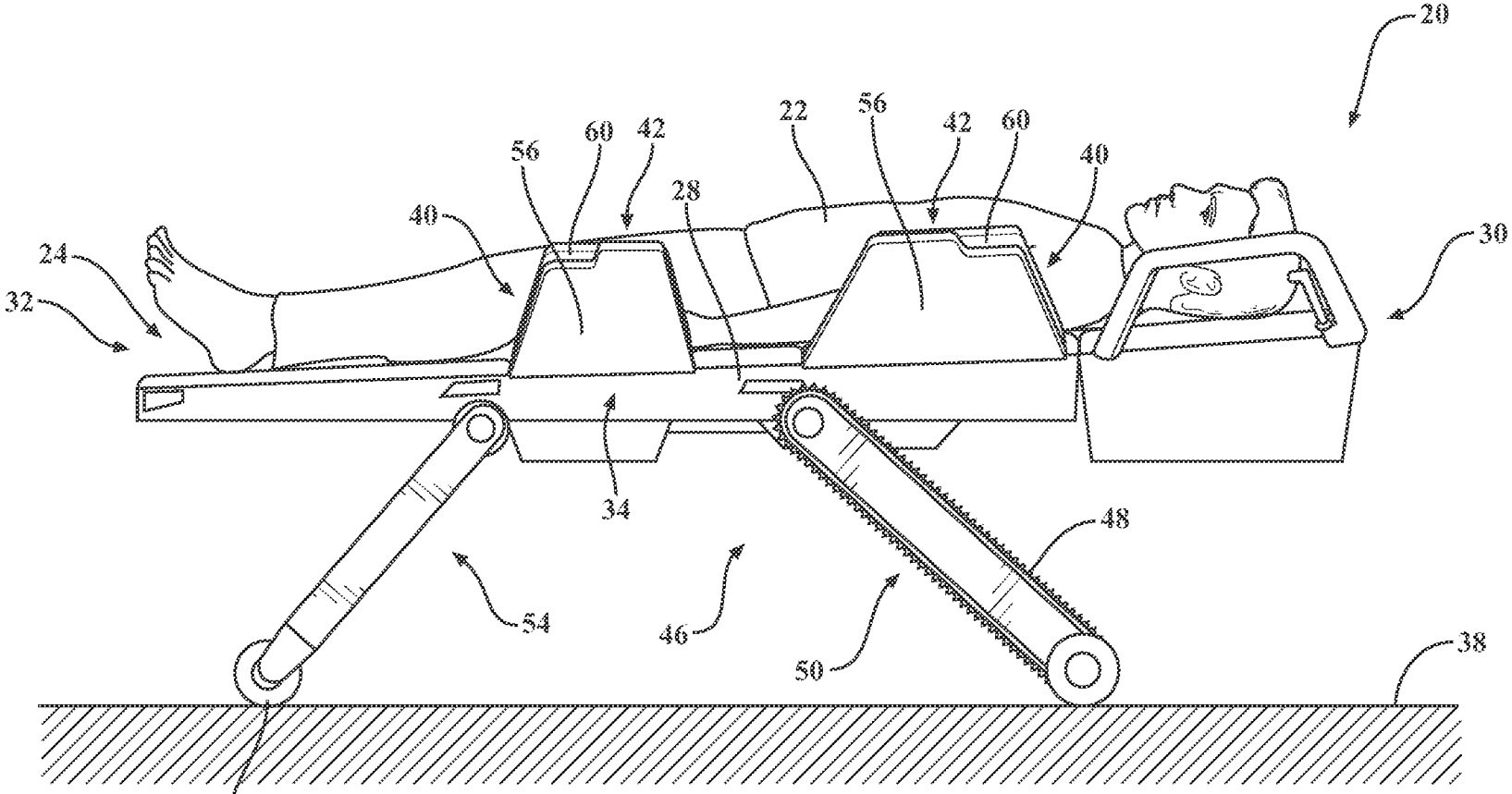
FIG. 7 is a side view of the patient support apparatus of FIG. 5, with the litter lift mechanism supporting the litter in a lifted litter position.
Figure 8A:
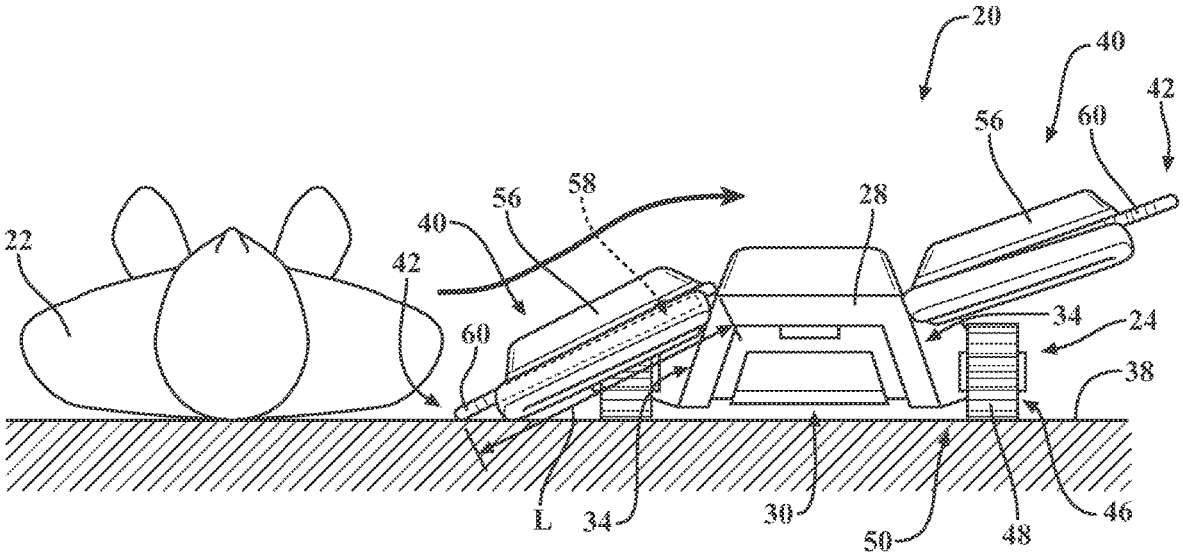
FIG. 8A is a side view of the patient support apparatus of FIG. 5 shown with the patient disposed on the floor surface adjacent the patient support apparatus.
Figure 8B:
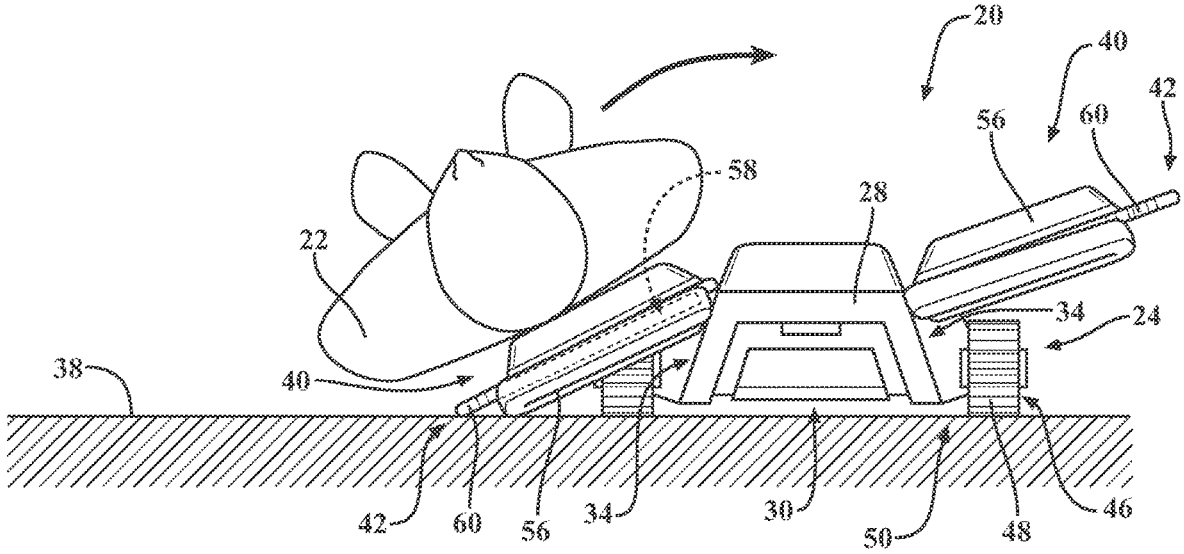
FIG. 8B is a side view of the patient support apparatus of FIG. 5 shown with the patient disposed on the side ramp of the patient support apparatus.
Figure 8C:
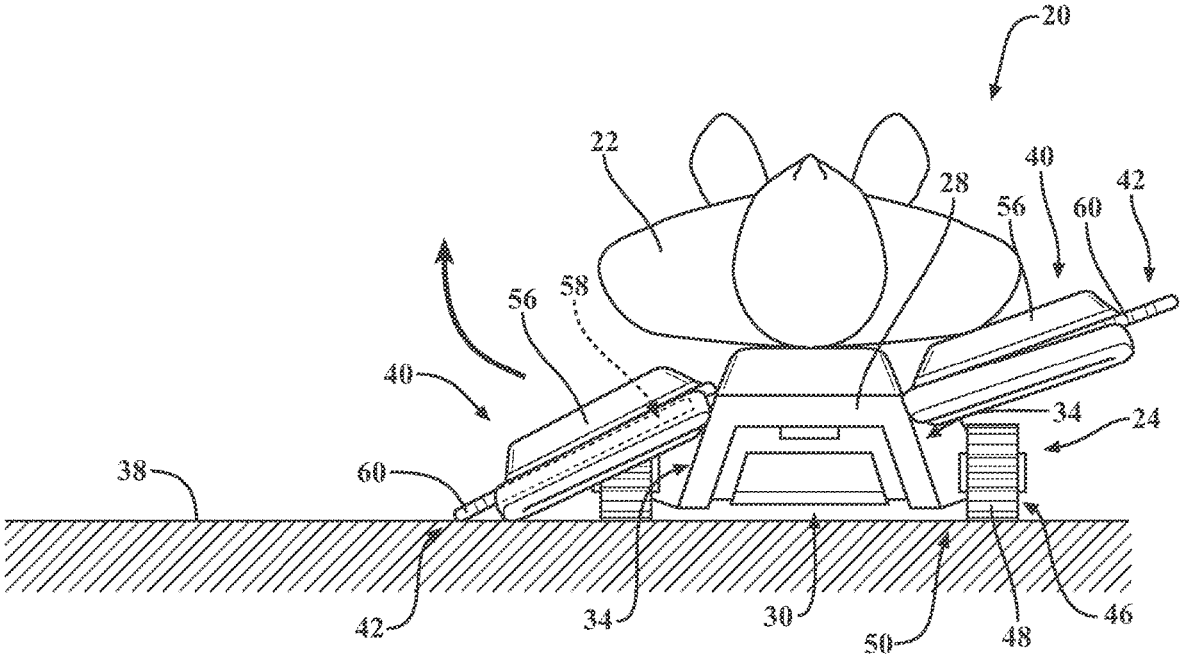
FIG. 8C is a side view of the patient support apparatus of FIG. 5 shown with the patient disposed on the patient support deck of the patient support apparatus.
Figure 8D:
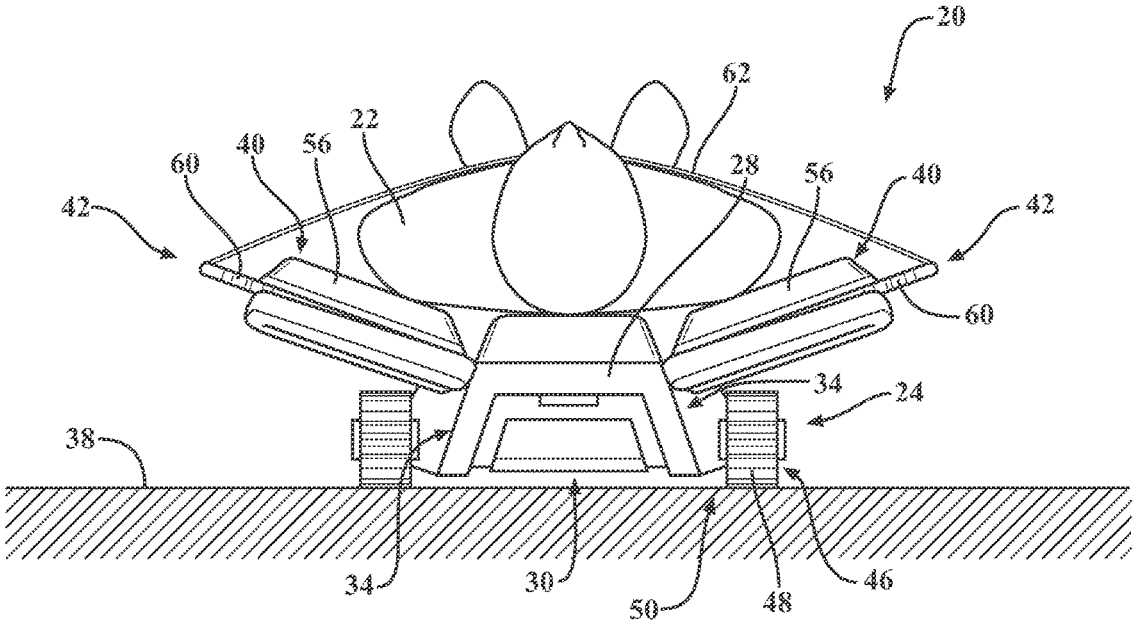
FIG. 8D is a side view of the patient support apparatus of FIG. 5 shown with the patient disposed on the patient support deck of the patient support apparatus, with both of the pair of side ramps in the first position.

In some embodiments, the patient support apparatus 20 may further comprise a transportation mechanism 46 coupled to the litter 24 for facilitating movement of the litter 24 along the floor surface 38, as shown in FIGS. 5-7. The transportation mechanism 46 may further comprise a continuous track 48 and a track driving device 50 propelling the continuous track 48 to provide mobility to the litter 24 along the floor surface 38. The track driving device 50 may also be configured to assist users in traversing a flight of stairs or rough/uneven surfaces that may not be easily traversed by the base 26 by mitigating the load users (e.g., caregivers) would otherwise be required to lift. In some configurations, the track driving device 50 may be configured to move the litter 24 across the floor surface 38 while the patient 22 is supported in a seated and/or a supine position. The track driving device 50 may further comprise wheels 52 rotatably coupled to the patient support deck 28 and configured to be disposed in contact with the floor surface 38. In the illustrated embodiments, the wheels 52 are freely rotatable. In alternative embodiments, the wheels 52 may be powered drive wheels that may be driven. The track driving device 50 may be configured to operate in the same manner or a similar manner as those shown in U.S. Pat. Nos. 9,486,373, 9,510,981, U.S. patent application Ser. No. 15/854,943, and/or U.S. patent application Ser. No. 15/854,199, previously referenced.

The patient support apparatus 20 may further comprise a litter lift mechanism 54 coupled to the litter 24, separate from the base lift mechanism 36, to move the patient support deck 28 vertically relative to the floor surface 38 when the litter 24 is separated from the base 26 between a lifted litter position (see FIG. 7) and a lowered litter position (see FIG. 6). More specifically, the litter lift mechanism 54 may be configured to raise and lower the patient 22 between the lifted and lowered litter positions of the litter 24, and intermediate positions therebetween when the litter 24 is separated from the base 26. To this end, the illustrated litter lift mechanism 54 may comprise one or more litter lift actuators coupled to a controller and the litter 24 to raise and lower the patient support deck 28 relative to the floor surface 38. The litter lift mechanism 54 may be powered (hydraulic, electric, etc.) or may be manually operated.

The side ramp 40 may be movable between the first and second positions when the litter 24 is separated from the base 26 (see FIGS. 8A-8D), with the engagement end 42 of the side ramp 40 configured to contact the floor surface 38 when in the lowered litter position to facilitate movement of the patient 22 along the side ramp 40 during loading of the patient 22 from the floor surface 38 to the patient support deck 28. As such, the side ramp 40 may be used with or without the base 26 in some embodiments. Furthermore, the engagement end 42 contacts the floor surface 38 in the lowered litter position to facilitate movement of the patient 22 along the side ramp 40 during loading of the patient 22 from the floor surface 38 to the patient support deck 28. The patient support deck 28 may be disposed at a first height H1 above the floor surface 38 in the lowered base position (see FIG. 2) and the patient support deck 28 may be disposed at a second height H2 above the floor surface 38 in the lowered litter position (see FIG. 6), with the second height H2 less than the first height H1. The differences between the first and second heights H1, H2 may be accommodated by adjusting the angle of the side ramp 40 in the second position to ensure engagement of the side ramp 40 with the floor surface 38. Further adjustments may be made to the side ramp 40 in order to ensure engagement of the side ramp 40 with the floor surface 38 and are discussed in greater detail below. As will be discussed, these adjustments may be applied to accommodate the differences between the first and second heights H1, H2.

The description below further describes aspects of the litter 24 and the side ramp 40. These features apply to the invention both when the litter 24 is coupled to the base 26 (see FIGS. 1-4D) and when the litter 24 is separated from the base 26 (see FIGS. 5-8D). As such, discussion of the litter 24 and the side ramp 40 below is applicable to both configurations of the patient support apparatus 20: coupled to and separated from the base 26. Furthermore, as mentioned above, movement of the side ramp 40 between the first and second positions may be performed in either of the configurations. As such, further description below regarding the movement of the side ramp 40 may be applicable to either of the configurations.

As described above, in the first position, the side ramp 40 is planar with or angled upwardly to extend above the patient support deck 28. Accordingly, the first position may be further defined as a plurality of first positions with the side ramp 40 adjustable between the plurality of first positions to configure the side ramp 40 to the patient 22 for inhibiting patient 22 egress. In the second position, the side ramp 40 is angled downwardly to extend below the patient support deck 28. Accordingly, the second position may be further defined as a plurality of second positions with the side ramp 40 adjustable between the plurality of second positions to configure the side ramp 40 to the patient 22 for contacting the floor surface 38 with the engagement end 42 when in the lowered base position or the lowered lift position to facilitate movement of the patient 22 along the side ramp 40 during loading of the patient 22 from the floor surface 38 to the patient support deck 28.

The side ramp 40 may not extend vertically below the patient support deck 28 in the second position. Said differently, the side ramp 40 may not extend straight up-and-down in the second position. More specifically, if the side ramp 40 were to have a vertical orientation in the second position, the side ramp 40 would not be able to convert horizontal movement into vertical movement. Instead, the patient 22 would merely abut the side ramp 40 and not move up the side ramp 40. As such, the downwardly-angled orientation of the side ramp 40 facilitates movement of the patient 22 from the floor surface 38 onto the patient support deck 28.

In some embodiments, the side ramp 40 may be extendable such that a side ramp length L between the engagement end 42 of side ramp 40 and the litter 24 is variable for adjusting the angle of the side ramp 40 in the second position, as shown in FIGS. 1 and 5. Said differently, the side ramp 40 may be lengthened or shortened to further adjust the angle of the side ramp 40 for ensuring movement of the patient 22 up the side ramp 40 during loading. For example, the side ramp length L of the side ramp 40 may be adjusted to accommodate when litter 24 is coupled to the base 26 (see FIG. 4A) and when the litter 24 is separated from the base 26 (see FIG. 8A). More specifically, the side ramp length L of the side ramp 40 may be adjusted to accommodate the differences between the first and second heights H1, H2 (compare FIGS. 4A and 8A). As described above, the first height H1 may be greater than the second height H2. Here, caregivers (e.g., emergency medical technicians) may reduce or otherwise adjust the angle of the side ramp 40 relative to the floor surface 38 to advantageously increase the horizontal distance over which the patient 22 is moved to gain height to facilitate ease in moving the patient 22 up the side ramp 40 to the patient support deck 28 (i.e., mechanical advantage). Therefore, in one embodiment the litter 24 is coupled to the base 26 and is disposed in the lowered base position having the first height H1 (greater than the second height H2), reducing the relative amount of manipulation to the patient 22 when the side ramp 40 may be lengthened to facilitate moving the patient 22 from the floor surface 38 to the patient support deck 28. In another embodiment, when the litter 24 is separated from the base 26 and is disposed in the lowered litter position having the second height H2 (less than the first height H1), the side ramp length L of the side ramp 40 may be shortened such as to accommodate situations where less horizontal distance is needed to move the patient 22 up to the second height H2.

As another non-limiting example, the side ramp length L of the side ramp 40 may be adjusted to accommodate uneven ground. More specifically, the patient 22 may be located in a location where the terrain is sloped or rugged. The first and second heights H1, H2 (i.e., the litter 24 coupled to or separated from the base 26) may be varied from what the first and second heights H1, H2 are in a planar, horizontal surface. As such, varying the side ramp length L of the side ramp 40 results in adjustment of the angle of the side ramp 40 in the second position to facilitate movement of the patient 22 up the side ramp 40 to patient support deck 28 when the patient 22 is not located on an ideal planar, horizontal surface.

As shown in the illustrated embodiments, the side ramp 40 may be extendable by way of telescopic translation. More specifically, as shown in FIGS. 4A-4C and 8A-8C, the side ramp 40 may comprise a first portion 56 pivotally coupled to the litter 24 and defining a cavity 58, and a second portion 60 extending into the cavity 58. The second portion 60 may be moved into and out of the cavity 58 for adjusting the side ramp length L of the side ramp 40 while being retained by the first portion 56 to prevent complete removal of the second portion 60 from the cavity 58. Said differently, the second portion 60 may be pulled out such that a substantial portion of the second portion 60 is disposed out of the cavity 58 to lengthen the side ramp length L of the side ramp 40. Alternatively, the second portion 60 may be pushed into the cavity 58 such that all or a substantial portion of the second portion 60 is disposed within the cavity 58 to shorten the side ramp length L of the side ramp 40. The second portion 60 may be positioned any suitable amount within the cavity 58 to adjust the side ramp length L of the side ramp 40. The telescopic movement between the first and second portions 56, 60 may be facilitated by the use of tracks, bearings, rollers, sliders, or any other suitable mechanism.

Although the side ramp length L of the side ramp 40 is shown to be adjustable in the Figures by way of telescopic translation, the side ramp length L may be adjusted in any other suitable manner. Non-limiting examples of adjusting the side ramp length L of the side ramp 40 include folding or rolling the side ramp 40.

As noted above, the patient support apparatus 20 may comprise more than one side ramp 40 in some embodiments. As such, the side ramp 40 may be further defined as a pair of side ramps 40. One of the side ramps 40 may be disposed along one of the lateral sides 34 and the other one of the side ramps 40 may be disposed along the other one of the lateral sides 34, as shown in FIGS. 4A-4D and 8A-8D. The pair of side ramps 40 may be configured to facilitate movement of the patient 22 along either of the side ramps 40 during loading of the patient 22 from the floor surface 38 to the patient support deck 28. Said differently, the litter 24 may configured to accommodate movement of the patient 22 up to the patient support deck 28 when the patient 22 is located on either of the pair of opposing lateral sides 34, increasing versatility of the patient support apparatus 20.

The pair of side ramps 40 may be pivotable independently of one another between respective first and second positions. As such, one of the pair of side ramps 40 may be in the second position to permit movement of the patient 22 from the floor surface 38 to the patient support deck 28, while the other one of the pair of side ramps 40 may be in the first position (see FIGS. 4A-4C and 8A-8C), which may engage the patient 22 after the patient 22 is placed on the patient support deck 28 (i.e., the other side ramp 40 in the first position extends the patient support deck 28 and may present a stop to prevent accidentally pushing the patient 22 off of the patient support deck 28.) However, the pair of side ramps 40 may both be simultaneously disposed in either of the first or second positions (see FIGS. 4D and 8D).

The patient support apparatus 20 may further comprise a patient retention member 62. As shown in the illustrated embodiments depicted throughout the description, the patient retention member 62 may comprise buckles and straps that facilitate longitudinal adjustments to the patient retention member 62 as well as quick coupling and decoupling between the pair of side ramps 40. However, the patient retention member 62 may comprise any other suitable mechanism for engaging the patient 22 and inhibiting patient 22 egress.

The patient retention member 62 may extend between the pair of side ramps 40 over the patient support deck 28 for engaging the patient 22 and inhibiting patient 22 egress. More specifically, each of the pair of side ramps 40 may extend to a respective engagement end 42, and the patient retention member 62 may extend between and may be coupled to the engagement end 42 of each of the side ramps 40 when both of the side ramps 40 are in the first position (see FIGS. 4D and 8D). Said differently, the patient retention member 62 may extend over the patient support deck 28. In one embodiment, the pair of side ramps 40 may be locked in the first position, for example, with a locking mechanism. In another embodiment, patient retention member 62 may pull the pair of side ramps 40 toward one another to hold the pair of side ramps 40 in the first position. The patient 22 may be positioned between the pair of side ramps 40 in the first position, with pair of side ramps 40 engaging the patient 22 to prevent inadvertent movement of the patient 22 laterally off of the patient support deck 28 (e.g., during transport). Furthermore, the patient 22 may engage the patient retention member 62 if the patient 22 was to move out of the space between pair of side ramps 40 (e.g., in an event where the patient support apparatus 20 tips over or otherwise becomes inverted).

In another embodiment, a plurality of side ramps 40 may be disposed along one of the sides 34 of the patient support deck 28 (see FIGS. 2, 3, 6, and 7) and configured to facilitate movement of the patient 22 along each of the side ramps 40 during loading of the patient 22 from the floor surface 38 to the patient support deck 28. More specifically, the plurality of side ramps 40 may collectively be used for loading the patient 22, with each of the plurality of side ramps 40 engaging a different portion of the patient 22 during loading.

The plurality of side ramps 40 may each individually correspond with the sections of the patient support deck 28. As such, the plurality of side ramps 40 facilitate articulation of the sections of the patient support deck 28. Said differently, the side ramps 40 do not extend between and are not coupled to two or more sections, which would limit the articulation of the sections relative to one another.

Several configurations have been discussed in the foregoing description. However, the configurations discussed herein are not intended to be exhaustive or limit the invention to any particular form. The terminology that has been used is intended to be in the nature of words of description rather than of limitation. Many modifications and variations are possible in light of the above teachings and the invention may be practiced otherwise than as specifically described.

What is claimed is:

1. A patient support apparatus for supporting a patient, the patient support apparatus comprising:

a litter comprising a patient support deck configured to support the patient, with the litter extending longitudinally between a first end and a second end;

a base arranged for movement along floor surfaces, the base being configured to removably support the litter selectively between:

a coupled configuration where the litter is coupled to the base for concurrent movement a floor surface, and a separated configuration where the litter is separated from the base for movement along the floor surface independent of the base;

a base lift mechanism coupled to the base and configured to move the litter relative to the floor surface in the coupled configuration between a lifted base position and a lowered base position;

a litter lift mechanism coupled to the litter, separate from the base lift mechanism, to move the patient support deck relative to the floor surface when the litter is separated from the base in the separated configuration between a lifted litter position and a lowered litter position; and a side ramp coupled to the patient support deck along the litter between the first and second ends and extending laterally away from the patient support deck to an engagement end, with the side ramp pivotable relative to the litter between:

a first position arranged planar with or angled upwardly to extend above the patient support deck for inhibiting patient egress, and a second position angled downwardly to extend below the patient support deck towards the floor surface when in the lowered base position to facilitate movement of the patient along the side ramp during loading of the patient from the floor surface to the patient support deck.

2. The patient support apparatus as set forth in claim 1, wherein the side ramp is extendable such that a side ramp length between the engagement end and the litter is variable during operation in the second position.

3. The patient support apparatus as set forth in claim 2, wherein the engagement end is arranged to contact the floor surface when the side ramp is extended during operation in the coupled configuration.

4. The patient support apparatus as set forth in claim 1, wherein the patient support deck comprises a pair of opposing lateral sides between the first and second ends, with the side ramp further defined as a pair of side ramps with one of the side ramps disposed along one of the lateral sides and the other of the side ramps disposed along the other of the lateral sides and configured to facilitate movement of the patient along either of the side ramps during loading of the patient from the floor surface to the patient support deck.

5. The patient support apparatus as set forth in claim 4, wherein the pair of side ramps are pivotable independently of one another between the first and second positions.

6. The patient support apparatus as set forth in claim 5, further comprising a patient retention member extending between the pair of side ramps over the patient support deck for engaging the patient and inhibiting patient egress.

7. The patient support apparatus as set forth in claim 6, wherein each of the side ramps extends to a respective engagement end, with the patient retention member extending between and coupled to the respective engagement end of each of the side ramps when both of the side ramps are in the first position.

8. The patient support apparatus as set forth in claim 4, wherein the pair of side ramps is further defined as a plurality of pairs of side ramps with at least two side ramps disposed along each of the lateral sides and configured to facilitate movement of the patient along each of the side ramps during loading of the patient from the floor surface to the patient support deck.

9. The patient support apparatus as set forth in claim 1, wherein the patient support deck comprises a pair of opposing lateral sides between the first and second ends and the side ramp is further defined as a plurality of side ramps disposed along one of the lateral sides and configured to facilitate movement of the patient along each of the side ramps during loading of the patient from the floor surface to the patient support deck.

10. The patient support apparatus as set forth in claim 9, wherein the side ramps are each movable between the first and second positions when the litter is separated from the base in the separated configuration, with the engagement ends of the side ramps configured to contact the floor surface when in the lowered litter position to facilitate movement of the patient along the side ramps during loading of the patient from the floor surface to the patient support deck.

11. The patient support apparatus as set forth in claim 9, wherein the patient support deck is disposed a first height above the floor surface in the lowered base position and the patient support deck is disposed a second height above the floor surface in the lowered litter position, with the second height being less than the first height.

12. The patient support apparatus as set forth in claim 1, further comprising a transportation mechanism disposed below and coupled to the litter for facilitating movement of the litter along the floor surface during operation in the separated configuration.

13. The patient support apparatus as set forth in claim 12, wherein the transportation mechanism comprises a continuous track and a track driving device propelling the continuous track to provide mobility to the litter along the floor surface during operation in the separated configuration.

14. A patient support apparatus for supporting a patient, the patient support apparatus comprising:

a litter comprising a patient support deck configured to support the patient, with the litter extending longitudinally between a first end and a second end, and with the patient support deck comprising a pair of opposing lateral sides;

a litter lift mechanism coupled to the litter and configured to raise and lower the patient support deck relative to a floor surface between a lifted litter position and a lowered litter position; and a plurality of side ramps coupled to the patient support deck along the litter between the first and second ends, with at least two side ramps disposed along each of the lateral sides, wherein each of the side ramps extends laterally away from the patient support deck to a respective engagement end and being pivotable relative to the litter between:

a respective first position arranged planar with or angled upwardly to extend above the patient support deck for inhibiting patient egress, and a respective second position angled downwardly to extend below the patient support deck towards the floor surface when in the lowered litter position to facilitate movement of the patient along the side ramp during loading of the patient from the floor surface to the patient support deck.

15. A patient support apparatus for supporting a patient, the patient support apparatus comprising:

a litter comprising a patient support deck configured to support the patient, with the litter extending longitudinally between a first end and a second end;

a base arranged for movement along floor surfaces, the base being configured to removably support the litter selectively between:

a coupled configuration where the litter is coupled to the base for concurrent movement a floor surface, and a separated configuration where the litter is separated from the base for movement along the floor surface independent of the base;

a base lift mechanism coupled to the base and configured to move the litter relative to the floor surface in the coupled configuration between a lifted base position and a lowered base position;

a litter lift mechanism coupled to the litter, separate from the base lift mechanism, to move the patient support deck relative to the floor surface when the litter is separated from the base in the separated configuration between a lifted litter position and a lowered litter position; and a side ramp coupled to the patient support deck along the litter between the first and second ends and extending laterally away from the patient support deck to an engagement end, with the side ramp pivotable relative to the litter between:

a first position arranged planar with or angled upwardly to extend above the patient support deck for inhibiting patient egress, and a second position angled downwardly to extend below the patient support deck towards the floor surface when in the lowered base position to facilitate movement of the patient along the side ramp during loading of the patient from the floor surface to the patient support deck;

wherein the patient support deck comprises a pair of opposing lateral sides between the first and second ends and the side ramp is further defined as a plurality of side ramps disposed along one of the lateral sides and configured to facilitate movement of the patient along each of the side ramps during loading of the patient from the floor surface to the patient support deck.

* * * * *